US006469426B1

(12) United States Patent
Hurst et al.

(10) Patent No.: US 6,469,426 B1
(45) Date of Patent: Oct. 22, 2002

(54) INCANDESCENT LAMP HAVING A HELICAL COIL THAT COMPRISES MULTIPLE SECTIONS OF DIFFERENT PITCHES

(75) Inventors: Derek Peter Hurst, Loughborough (GB); Paul Anthony Grazier, Leicester (GB); Anthony John Perrin, Leicester (GB); Kantilal Dhanjibhai Mistry, Leicester (GB); Francis Gerald Decort, Leicester (GB)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/286,521

(22) Filed: Apr. 6, 1999

(30) Foreign Application Priority Data

Apr. 9, 1998 (GB) ..... 9807842

(51) Int. Cl.[7] ..... H01J 17/20; H01J 61/12; H01K 1/50

(52) U.S. Cl. ..... 313/315; 313/578; 445/27

(58) Field of Search ..... 313/491–92, 631–32, 313/628, 344, 634–35, 573, 574, 578, 271, 274, 277, 275, 273, 279, 315; 445/46, 48–49, 32–33, 35, 23–24, 26; 140/71.5

(56) References Cited

U.S. PATENT DOCUMENTS

| | | | | |
|---|---|---|---|---|
| 3,942,063 A | | 3/1976 | Winter et al. | |
| 3,983,441 A | | 9/1976 | Northrup | |
| 4,272,698 A | | 6/1981 | Oyama et al. | |
| 4,959,585 A | * | 9/1990 | Hoegler et al. | 313/271 |
| 5,079,475 A | * | 1/1992 | Oortman Gerlings et al. | 313/279 |
| 5,578,892 A | * | 11/1996 | Whitman et al. | 313/635 X |
| 5,962,972 A | * | 10/1999 | Engels et al. | 313/578 |
| 6,137,228 A | * | 10/2000 | Aizawa et al. | 313/631 |

FOREIGN PATENT DOCUMENTS

| | | |
|---|---|---|
| EP | 0 020 274 A1 | 12/1980 |
| EP | 0 163 348 A1 | 12/1985 |
| EP | 0 438 254 A3 | 7/1991 |
| EP | 0 438 254 A2 | 7/1991 |
| EP | 0 533 478 A1 | 3/1993 |
| GB | 1 505 749 | 3/1978 |
| GB | 2 041 643 A | 9/1980 |
| GB | 2 139 341 A | 11/1984 |
| JP | 08-069779 | 12/1996 |

* cited by examiner

*Primary Examiner*—Kenneth J. Ramsey
*Assistant Examiner*—Mack Haynes
(74) *Attorney, Agent, or Firm*—Fay, Sharpe, Fagan, Minnich & McKee, LLP

(57) ABSTRACT

An incandescent lamp element comprises an envelope and a filament (10) supported therein by a plurality of spaced supports. The filament comprises a helical coil of wire with sections (20, 21) having at least two different pitches. The first sections (20) have a pitch which enables the filament to be operated at a required colour temperature, and the second sections have a pitch which enables the filament to be supported by the supports.

3 Claims, 2 Drawing Sheets

INCANDESCENT LAMP HAVING A HELICAL COIL THAT COMPRISES MULTIPLE SECTIONS OF DIFFERENT PITCHES

BACKGROUND OF THE INVENTION

This invention relates to a filament of the kind used in lamps, particularly, although not exclusively, in heater lamps. The invention is especially concerned with the support of such a filament within an envelope such as a quartz tube.

A popular form of heater lamp is the circular shaped tungsten halogen lamp used for cooker and heater applications. In such lamps, a filament, usually a coil of tungsten wire, is supported centrally within a quartz tube. An example of such a circular heater lamp is described in EP-A-0438254. As indicated in the drawings of the patent specification, the filament is supported at spaced intervals around the tube. A more detailed disclosure of examples of supports for a filament within a tube is given in EP-A-0020275, which relates to a linear filament lamp. Although the present invention will be described in connection with a heater lamp, it is equally applicable to incandescent lamps, i.e. lamps emitting visible light.

When a circular heating lamp, such as a cooking lamp, is at fill power the filament temperature is approximately 2300 K. If the heated filament is allowed to touch the quartz envelope, the quartz quickly degrades and leaks (due to de-vitrification and the formation of leak-paths along the grain boundaries), thereby rendering the lamp useless. The filament therefore needs to be securely maintained away from the wall of the envelope, and this may be done by providing circular filament supports, each comprising a wound tungsten ring that locks on to the filament and forms a spiral which centralises the filament within the quartz tube. Current designs of filaments use a coil having a pitch ratio within a certain range. The pitch ratio is defined as the pitch (between adjacent turns of the coil) divided by the diameter of the wire. This pitch ratio is typically between 1.2 and 1.9. For some applications, it is desirable to increase the pitch ratio above 1.9. However, once the pitch ratio is above about 1.8, the support no longer firmly grips, or locks on to, the filament, thereby enabling the filament to move within the support, and possibly to touch the envelope wall. This has the disadvantage that filament designs are constrained to the current range of pitch ratios, so that certain combinations of colour temperature, filament length and power rating are not possible.

SUMMARY OF THE INVENTION

It is an object of the present invention to overcome this disadvantage. According to the present invention there is provided an incandescent lamp filament comprising a helical coil of wire, characterised in that the coil comprises sections having at least two different pitches, including a first section having a pitch which enables the filament to be operated at a required colour temperature, and a second section having a pitch which enables the filament to be supported by support means which engages the coil.

The invention also provides a lamp comprising an envelope and a filament supported therein by a plurality of spaced supports, the filament being in accordance with the preceding paragraph, and having a plurality of said second sections spaced apart from one another and engaging respective ones of the supports.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
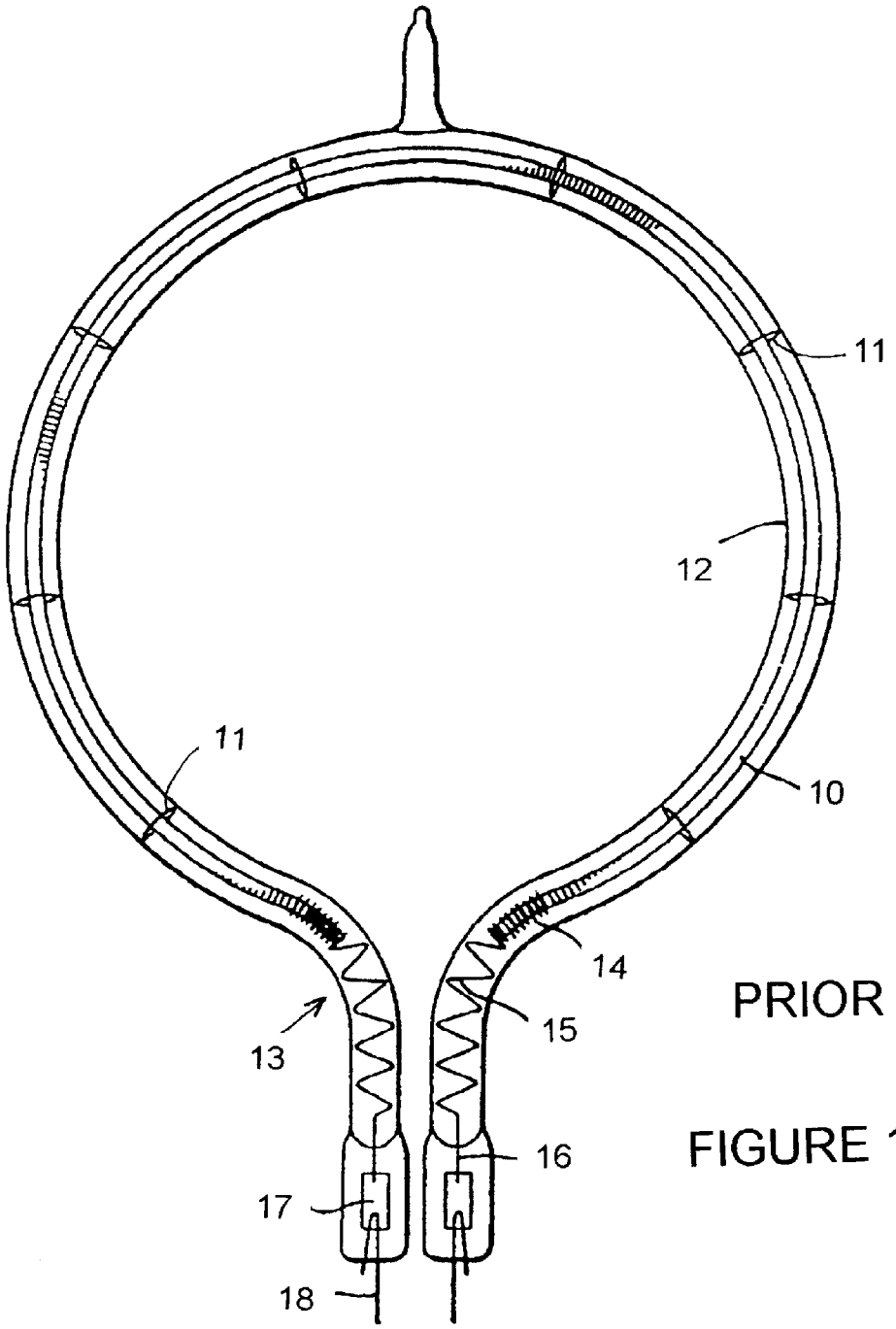
PRIOR ART FIGURE 1
FIG. 1 shows a circular heater lamp of known kind.

Referring to FIG. 1, a filament 10 is supported at spaced intervals by supports 11 within a generally circular tube 12. The filament 10 is helical coil, for example of tungsten wire, and the tube 12 may be of quartz. The filament wire may be of any suitable cross-section, typically circular, elliptical, square or rectangular. The supports 11, which are typically also of tungsten wire, can be a wound spiral arrangement, the outer part of which engages the inner wall of the tube 12 and the inner part of which locks on to the filament 10. Alternative support arrangements are shown in EP-A-0020075. Each end of the filament 10 is supported by a so-called plug 13, which consists of a generally cylindrical wound section 14, which engages either inside or outside the end portion of the filament 10, and a helical portion 15 which terminates in a straight wire portion 16 that is welded to a molybdenum foil 17. An external lead 18 is connected to the foil 17.

Figure 2:
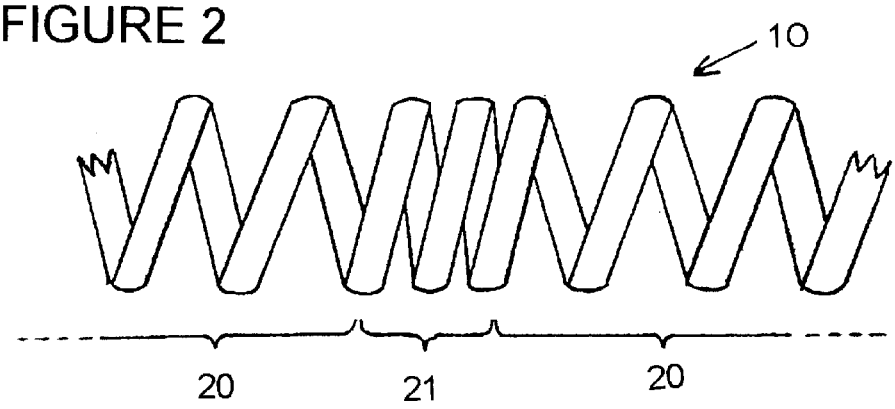
FIG. 2 is a side view of part of a filament in accordance with the invention.

Referring now to FIG. 2, a filament 10 in accordance with the invention comprises a helical coil having a first section 20 with a relative open pitch, which enables the filament to achieve the desired operating characteristics, and a second section 21 having a relatively closed pitch to enable that part of the filament to be engaged by a support. There are as many second sections 21 as are necessary to engage the number of supports provided within the tube 12. By keeping the pitch ratio of the second sections less than about 1.9, for example between 1.2 and 1.9, it is ensured that the support can lock on to the filament. The first sections of the filament, which are the open pitch "active" sections, can have a greater pitch ratio than hitherto, for example from 1.8 to 5 or even higher. This enables considerable latitude in the design of the lamp to provide the required colour temperature, filament length and power ratings.

Figure 3:
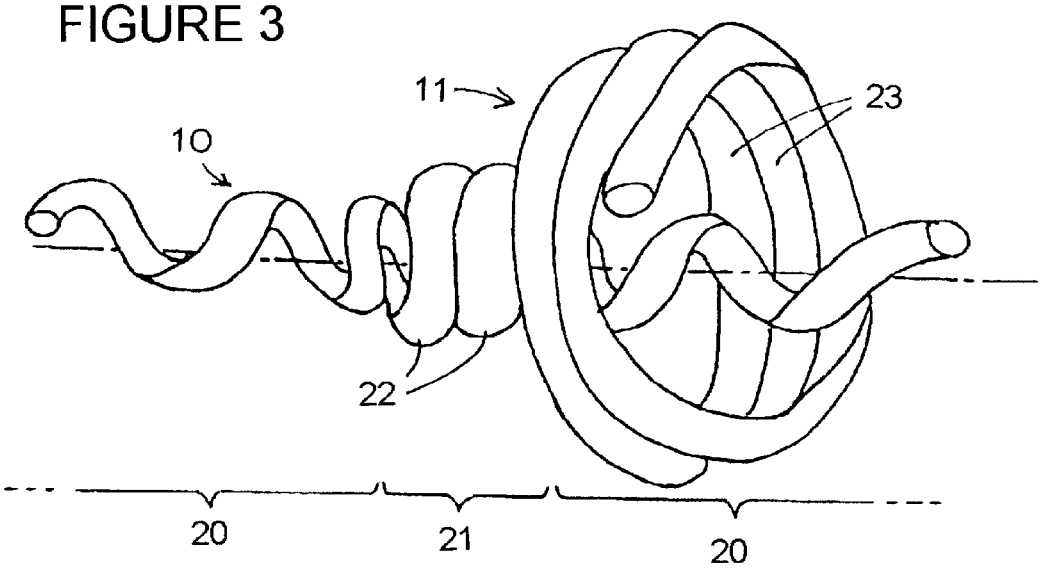
FIG. 3 is a perspective view of part of a filament in accordance with the invention, engaged by a support.
Figure 4:
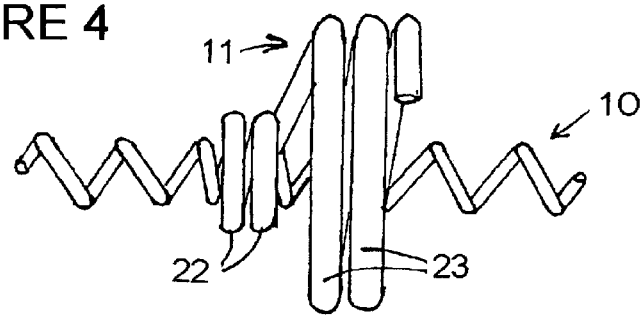
FIG. 4 is a side view of the filament and support of FIG. 3.

Referring now to FIGS. 3 and 4, part of a filament 10 is shown supported by a support 11. The second, or closed pitch, section 21 of the filament 10 is supported by smaller diameter turns 22 of the support 11, while the larger diameter turns 23 of the support 11 are of a diameter which engages the internal cylindrical wall of the tube. By way of example, the outside diameter of the filament coil may be 2 millimeters, while the outside diameter of the larger turns 23 of the support 11 maybe about 5 millimeters. The closer spacing of the turns of the filament 10 in the second section 21 ensures that the smaller diameter turns 22 of the support 11 firmly engage, or lock on to, the filament. In the support 11 which is shown in FIGS. 3 and 4, the support forming wire is meshed for one complete turn in between adjacent turns of the filament, and is then back wound over the outside of the filament for two complete turns. In other words, the back wound turns 22 are wound in a direction towards the larger turns 23 of the support. The back wound turns 22, which are the turns visible in FIG. 4, trap the first turn of the smaller diameter turns between adjacent turns of the filament. This firmly holds the filament in place. In FIG. 4, the back wound turns are visible, but the trapped turn is hidden behind them.

In constant pitch filament manufacture, typically the support wire diameter is 10% greater than the size of the gaps between adjacent turns of the filament. If this practice was applied to the required colour temperature and lit length mentioned above, where the filament wire diameter is 0.3 millimeters, and the gap between adjacent turns is 0.6 millimeters, a support wire diameter of 0.66 millimeters would be needed. Physically forming tungsten wire of this size is extremely difficult, and would almost certainly result in splitting of the tungsten wire, causing damage to the machine tooling. The present invention overcomes this difficultly by enabling the use of thinner support wire. Thus, if the gap between turns in the second section is 0.3 millimeters, the support wire need only be 0.33 millimeters in diameter.

The filament of the invention allows the active filament sections to be designed with whatever pitch ratio is required, including pitch ratios greater than 1.9, and allows the closed pitch sections, for anchoring the filament supports, to have a pitch ratio less than 1.9. The number of active sections and closed pitch support sections is determined by the required radius of the lamp and the required lit length. Furthermore, the ends of the filament can be wound with a pitch ratio of less than 1.9 to allow the filament plugs to better lock on to the filament.

What is claimed is:

1. An incandescent lamp filament comprising:

a helical coil of wire including sections having at least two different pitches, a first section having a pitch which enables the filament to be operated at a required colour temperature, and a second section having a pitch which enables the filament to be supported by support means which engages the coil, wherein the pitch ratio of the first section is greater than 1.9 and the pitch ratio of the second section is less than 1.9.

2. An incandescent lamp assembly comprising an envelope and a filament supported therein by a plurality of spaced supports, wherein the filament includes sections having at least two different pitches, a first section having a pitch which enables the filament to be operated at a required colour temperature, and a plurality of second sections spaced apart from one another and having a pitch which enables the filament to be supported by the supports which engage the filament, wherein each support comprises a coiled wire having a helical inner portion for engaging a second section of the filament, and a helical outer portion for engaging the inner wall of the envelope, wherein a first turn of the helical inner portion of the support engages a gap between two adjacent turns of a second section of the filament, and at least one other turn of said helical inner portion is back wound over said first turn to trap the first turn in place in the filament.

3. The lamp assembly of claim 2 wherein the pitch ratio of the first section is greater than 1.9 and the pitch ratio of the second section is less than 1.9.

* * * * *